US006170692B1

(12) United States Patent
Johnston

(10) Patent No.: US 6,170,692 B1
(45) Date of Patent: Jan. 9, 2001

(54) ANIMAL WASTE BAG DISPENSER AND DISPOSAL UNIT

(76) Inventor: James A. Johnston, 18959 N. Dallas Pkwy., Dallas, TX (US) 75287

( * ) Notice: Under 35 U.S.C. 154(b), the term of this patent shall be extended for 0 days.

(21) Appl. No.: 09/436,424

(22) Filed: Nov. 9, 1999

(51) Int. Cl.[7] ..... B65D 25/22

(52) U.S. Cl. ..... 220/475; 220/23.83; 220/908; 248/907; 248/146

(58) Field of Search ..... 220/475, 495.07, 220/495.06, 23.83, 23.86, 908; 221/33, 199, 282; 248/146, 907

(56) References Cited

U.S. PATENT DOCUMENTS 4,143,792 * 3/1979 Rex .
4,823,979 * 4/1989 Clark, Jr. ..... 220/407
4,860,909 * 8/1989 Leumi ..... 220/475
5,067,626 * 11/1991 Leumi ..... 220/475
5,261,585 * 11/1993 Simhaee ..... 225/47
5,294,012 * 3/1994 Shott et al. ..... 220/23.4
5,458,243 * 10/1995 McBride ..... 206/503
5,579,915 * 12/1996 Liss ..... 206/554
5,619,915 * 4/1997 Wagner et al. ..... 100/98 R
5,704,511 * 1/1998 Kellams ..... 220/407

* cited by examiner

*Primary Examiner*—Stephen Castellano
(74) *Attorney, Agent, or Firm*—George L. Williamson

(57) ABSTRACT

The present invention discloses an animal waste bag dispenser and disposal unit comprising a mounting bracket, a container for holding bags, having a bucket and lid, and a receptacle. The container and receptacle are attached to the mounting bracket by nuts and bolts which extend through apertures positioned along the length of the mounting bracket. Bands wrapping around the mounting bracket through a plurality of notches enable the bracket to be attached to a pole or tree. These bands allow the height of the unit to be adjusted to a convenient level along the pole. The front side of the bucket has an opening through which bags contained inside can be retrieved. The bucket is covered by a lid having a lip which extends downward from the lid over the bucket. The lid prevents the natural elements, namely rain and snow, from seeping into the bucket; thus, the bags contained within the container remain dry and clean. The receptacle has a hollow body and top and bottom caps, thereby enabling the receptacle to be emptied when full.

12 Claims, 4 Drawing Sheets

ANIMAL WASTE BAG DISPENSER AND DISPOSAL UNIT

BACKGROUND OF THE INVENTION

1. Field of the Invention

The present invention relates generally to an animal waste bag dispenser and disposal unit. More particularly, the unit facilitates the collection and disposal of animal waste by making the bag readily available, as well as providing a convenient receptacle.

2. Description of the Prior Art

With the rapid influx of pet ownership, the problem of animal waste has also increased. Most pets, particularly dogs, defecate outdoors, which poses a potential health problem. Many pet owners find the task of collecting and disposing of their animals waste to be distasteful; thus, the waste is often left where deposited.

Pet owners who may be more willing to clean up after their pets often find the available products to be awkward or unpleasant. Many of the scoops and shovels presently available are cumbersome to carry while walking a pet. They can also be heavy to carry and awkward to manipulate, thereby frustrating the potential user. Further, it is common to forget to take a plastic bag from one's home when leaving to walk a pet. Thus, when the pet defecates, the owner is bound to leave it where it lies.

U.S. Pat. No. 5,370,431 to Henninger, et al., discloses an apparatus for the sanitary gathering and retention of animal waste for disposal. The device allows for the gathering of pet waste into a disposable bag without soiling one's hands. However, this device may be found to be awkward to operate since it involves the manipulation of a scissors-like device.

U.S. Pat. No. 5,438,708 to Jacovitz shows a manual waste collection, containment, and disposal device in the form of a glove. U.S. Pat. No. 5,511,682 to Pace discloses a portable animal waste collector/storage apparatus.

U.S. Pat. No. 5,167,377 to Chalmers discloses an animal waste bag dispenser that stores bags on a cylindrical roll.

U.S. Pat. No. 5,335,952 to Clapper discloses an apparatus and method for animal waste pick-up and disposal comprising an elongated shaft that is attached to spring-biased scoop members. A plastic bag would be placed over the members in order to allow a user to retrieve animal waste without physical contact.

While these devices may be suitable for the purposes for which they were designed, they would not be as suitable for the purposes of the present invention, as hereinafter described.

SUMMARY OF THE INVENTION

The present invention discloses an animal waste bag dispenser and disposal unit comprising a mounting bracket, a container for holding bags, having a bucket and lid, and a receptacle. The container and receptacle are attached to the mounting bracket by nuts and bolts, which extend through apertures positioned along the length of the mounting bracket. Bands wrapping around the mounting bracket through a plurality of notches enable the bracket to be attached to a pole or tree. These bands allow the height of the unit to be adjusted to a convenient level along the pole. The front side of the bucket has an opening through which bags contained inside can be retrieved. The bucket is covered by a lid having a lip which extends downward from the lid over the bucket. The lid prevents the natural elements, namely rain and snow, from seeping into the bucket; thus, the bags contained within the container remain dry and clean. The receptacle has hollow body and top and bottom caps, thereby enabling the receptacle to be emptied when full. The receptacle is mounted on the bracket so that it can be rotated 360 degrees so that it can be easily emptied.

It is an object of the present invention to produce an animal waste bag dispenser and disposal unit that facilitates the collection and disposal of animal waste. It is a further object of the invention to produce an animal waste bag dispenser and disposal unit that is easily refilled with plastic bags.

It is a still further object of the present invention to produce an animal waste bag dispenser and disposal unit having a receptacle that is attached to the pole. After using a bag to clean up after a pet, the user can deposit the bag and waste into the receptacle, comprising hollow body and top and bottom caps.

It is a still further object of the present invention to produce an animal waste bag dispenser and disposal unit that consists of an elongated mounting bracket onto which a bag dispenser and receptacle are secured. This configuration allows for placement of the dispenser outside, thereby acting as a reminder to pet owners to take a bag when walking their pets.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

The following detailed description is, therefore, not to be taken in a limiting sense, and the scope of the present invention is best defined by the appended claims.

BRIEF DESCRIPTION OF THE DRAWINGS

In the drawings, like elements are depicted by like reference numerals. In order that the invention may be more fully understood, it will now be described, by way of example, with reference to the accompanying drawings in which.

LIST OF REFERENCE NUMERALS

Figure 1:
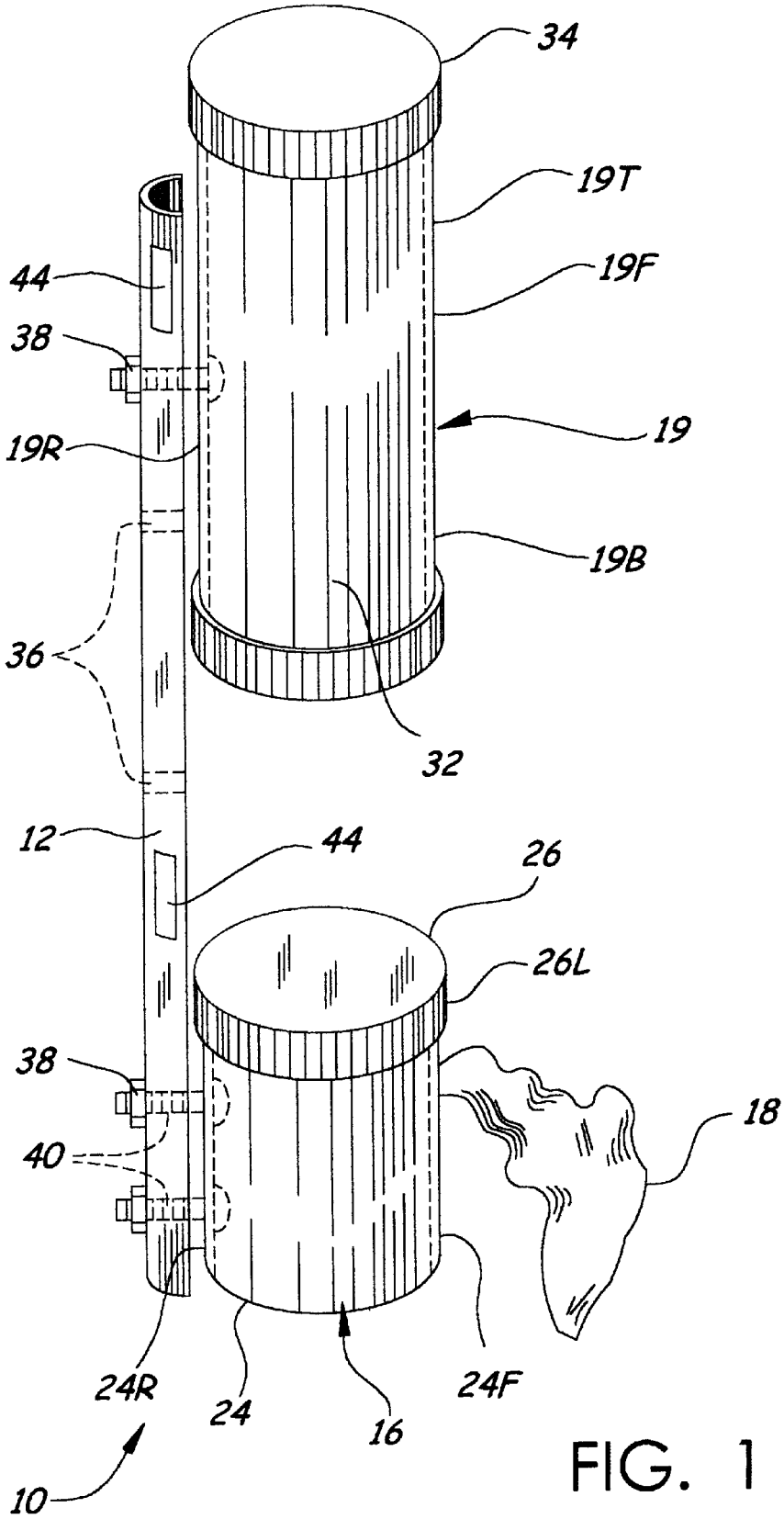
FIG. 1 is a side perspective view of the animal waste bag dispenser and disposal unit.

With regard to reference numerals used, the following numbering is used throughout the drawings.

10 present invention
12 mounting bracket
16 container
18 bag
19 receptacle
19T top
19B bottom
19F front
19R rear
24 bucket
24F front

24R rear
26 lid
26L lip
28 bands
30 opening
32 body
34 cap
36 apertures
38 nuts
40 bolts
42 pole
44 notches
46 first mounting bracket
48 second mounting bracket

DESCRIPTION OF THE PREFERRED EMBODIMENT(S)

Figure 2:
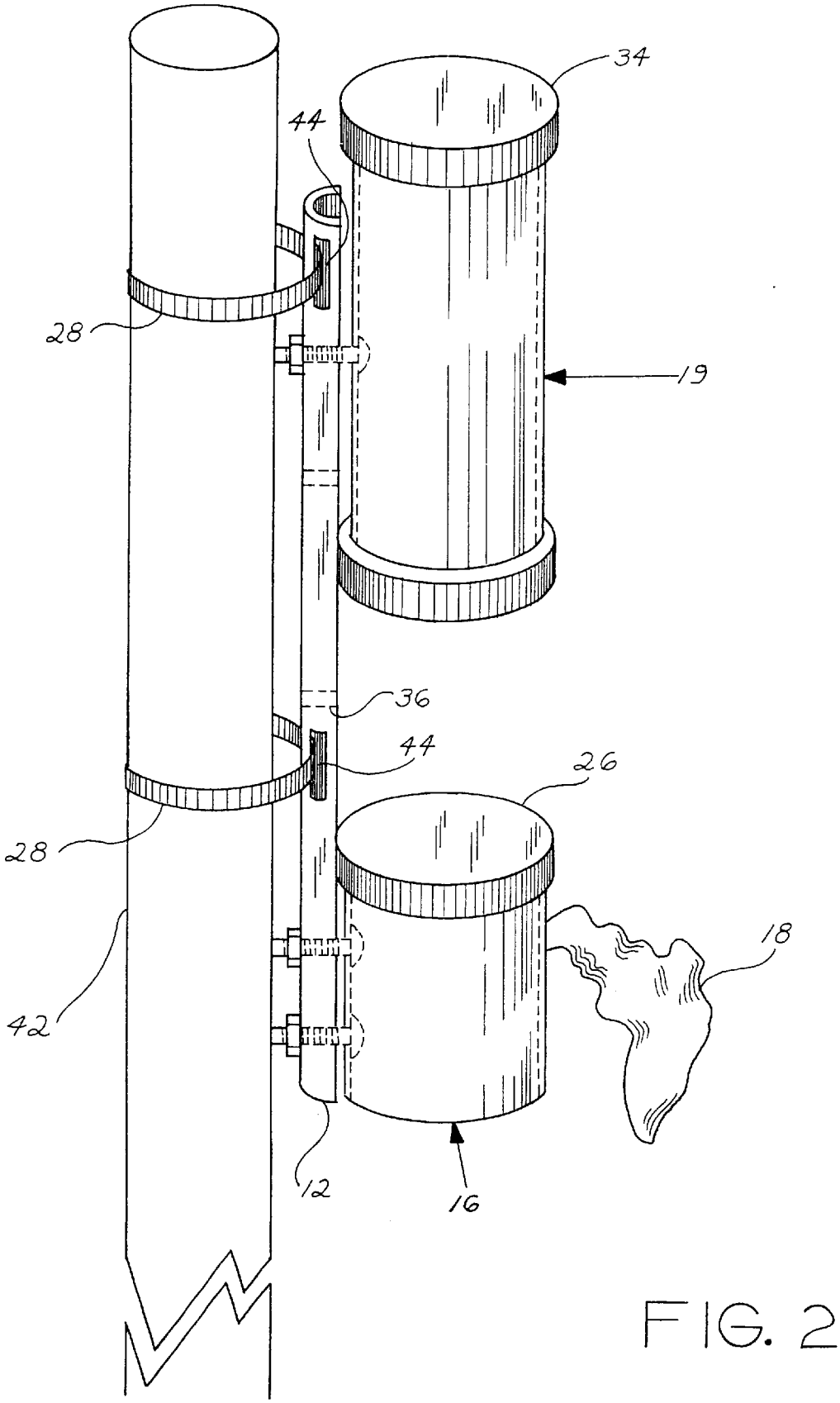
FIG. 2 is a side perspective view of the animal waste bag dispenser and disposal unit, mounted on a pole.
Figure 3:
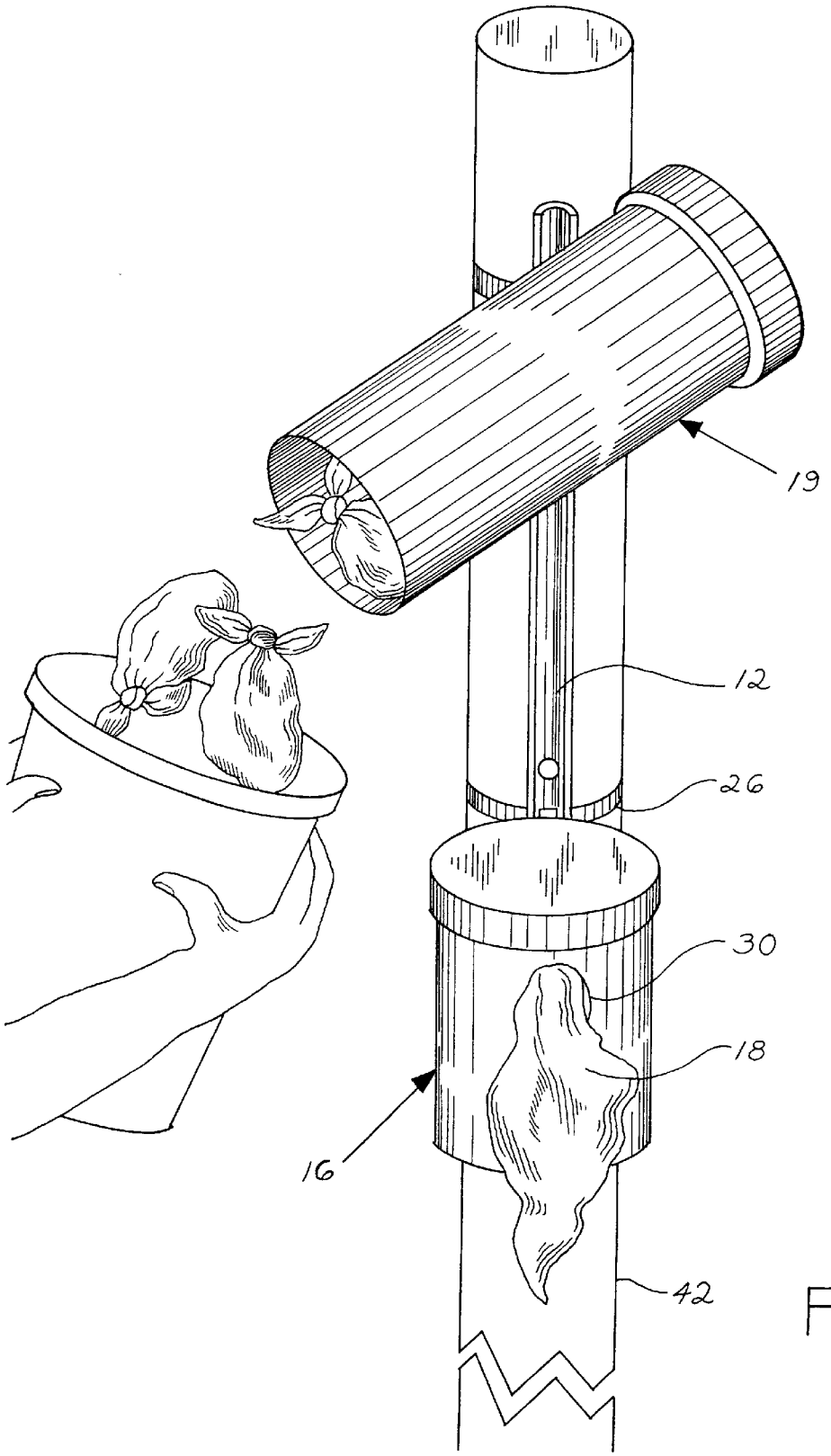
FIG. 3 is a front perspective view of the animal waste bag dispenser and disposal unit, illustrating the receptacle being emptied.

Turning now descriptively to the drawings, in which similar reference characters denote similar elements throughout the several views, FIGS. 1 through 3 illustrate the present invention being an animal waste dispenser and disposal unit.

Turning to FIG. 1, therein is shown an animal waste bag dispenser and disposal unit 10, comprising a mounting bracket 12, a container 16 which holds a plurality of bags 18, and an elongated receptacle 19.

The mounting bracket 12 has a plurality of apertures 36 positioned along the length of said bracket 12 in order to accommodate the container 16 and receptacle 19.

The container 16 portion of the unit 10 comprises a bucket 24 open on one end, having a front side 24F and a rear side 24R, and a lid 26, having a lip 26L that extends downward from said lid 26. The purpose of the cylindrical container 16 is to hold bags 18 for distribution. Once the container 16 is empty of bags 18, a user would remove the lid 26 from the bucket 24 and simply refill the supply of bags 18. The lid 26 of the container 16 is slightly larger in diameter than the bucket 24. Thus, when the lid 26 is in place on the bucket 24, the lip 26L rests adjacent to the bucket 24. This construction of the container 16 provides for cleanliness inside said container 16. In the event the unit 10 is placed outdoors, the lid 26 of the container 16 would prevent the natural elements, such as rain and snow, from getting inside the bucket 24, thereby keeping the bags 18 clean and dry. The front side 24F of the bucket 24 has a second opening 30 (see FIG. 30) through which a user can retrieve the bags 18 held inside the container 16.

The elongated receptacle 19, having a top portion 19T, a bottom portion 19B, a front side 19F and a rear side 19R, is attached to the mounting bracket 12, preferably above the container 16. The body 32 of the receptacle 19 is hollow in order to hold waste. A cap 34, slightly larger in diameter than the body 32, is positioned on the bottom portion 19B and the top portion 19T of the body 32. After removing a bag 18 from the container 16 and cleaning up after a pet, a user can conveniently remove the cap 34 on the top portion 19T of the receptacle 19, deposit the bag 18 and waste in the hollow body 32 and return the cap 34 to its place.

The container 16 and receptacle 19 are attached to the means for mounting, e.g., a mounting bracket 12 by a plurality of bolts 40 protruding from the rear sides 24R and 19R of the container 16 and receptacle 19. The bolts 40 are positioned through the multiple apertures 36 along the mounting bracket 12. The height of the container 16 and receptacle 19 can be adjusted according to the preference of the user by using higher or lower apertures 36 along the mounting bracket 12. Nuts 38, coupled with the bolts 40, secure the container 16 and receptacle 19 to the mounting bracket 12.

The mounting bracket 12 is constructed in such a manner as to make is possible to add attachment pieces to said bracket 12; thus, the height of the unit 10 can be varied according to need.

Turning to FIG. 2, alternatively, the mounting bracket 12 may be attached to an upstanding pole 42 or tree by bands 28 which extend around said pole 42. The elongated strap-like bands 28 are wrapped around the pole 42 and are attached to the mounting bracket 12 through a plurality of aperture-like notches 44 extending through the said bracket 12.

Turning to FIG. 3, therein is shown the receptacle 19 of the animal waste bag dispenser and disposal unit 10 being emptied. The cap 34 is removed and the receptacle 19 is pivoted downward at an angle greater than ninety degrees in order to empty the contents thereof. Once empty, the cap 34 is replaced and the receptacle 19 is returned to its upright position for further use.

Alternatively, rather than being attached to a pole 42 or tree, additional brackets can be attached to the pre-existing mounting bracket 12 in order to vary the height of the dispenser and disposal unit 10. The bracket 12 can be inserted into the ground, thus creating a freestanding unit 10.

The animal waste bag dispenser and disposal unit 10 can ideally be placed at curbs or outside apartment buildings. Thus, a pet owner can simply take a bag 18 from the unit 10 upon walking his/her pet and then proceed to deposit the bag 18 and the animal waste back into the receptacle 19. Periodically, the receptacle 19 would be emptied to allow more waste to be deposited.

Figure 4:
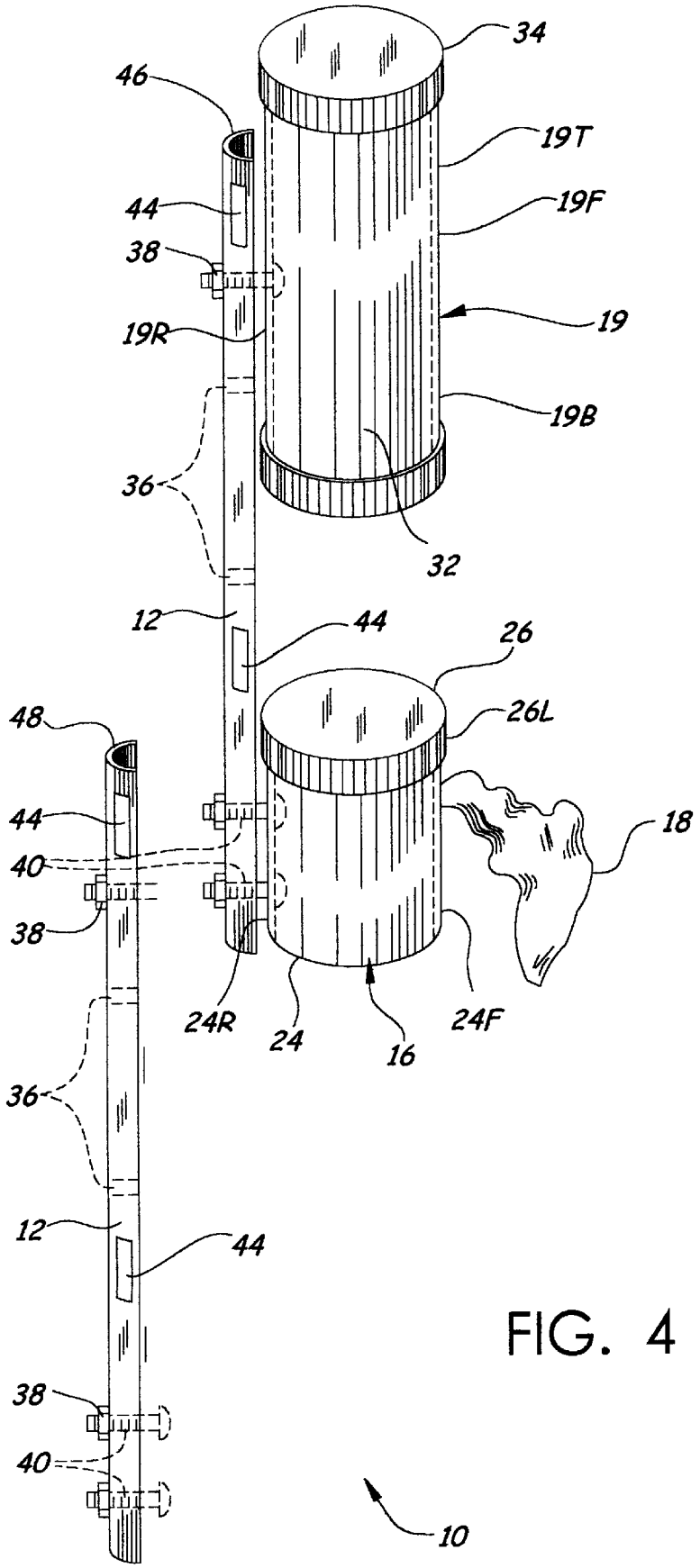
FIG. 4 is a side perspective view of the animal waste bag dispenser and disposal unit showing an alternative means for connecting the mounting bracket.

Turning to FIG. 4, therein is shown a side perspective view of the animal waste bag dispenser and disposal unit 10 showing an alternative means for connecting a first length of mounting bracket 46 to a second length of mounting bracket 48. This is accomplished by placing the first bracket 46 adjacent to the second bracket 48 and connecting the two members 46,48 with at least one nut 38 and bolt 40 or other suitable fastener as would be done in the standard manner by one skilled in the art. The purpose of this embodiment is to allow an upstanding longer pole member to be formed for mounting the bag dispenser and disposal unit 10 without having a separate pole 42 (not shown) as has been previously disclosed. The lower end of the mounting bracket 48 can then be inserted into the ground to form the upstanding pole member.

What is claimed to be new and desired to be protected by letters patent is set forth in the appended claims:

I claim:

1. An apparatus for management of animal waste, comprising:

a) a plurality of bags;

b) a means for dispensing said bags;

c) a means for receiving said bags;

d) a means for attaching in a generally upstanding position said means for dispensing and said means for receiving said bags; and, e) a generally upstanding means for mounting for receiving said means for attaching.

2. The apparatus of claim 1, said means for dispensing said bags further comprising a cylindrical member having a first opening on one end for receiving said bags, said cylindrical member having a second opening through which said bags are dispensed.

3. The apparatus of claim 2, said first opening having a cap for closing said first opening, said second opening disposed in a side wall of said cylindrical member.

4. The apparatus of claim 3, said means for dispensing having multiple apertures therein disposed in a side wall, said apertures for receiving a fastener whereby said cylindrical member can be attached to said means for mounting.

5. The apparatus of claim 1, said means for receiving said bags further comprising a cylindrical member having one end open for receiving said bags.

6. The apparatus of claim 5, further comprising said open end having a cap for being closed.

7. The apparatus of claim 6, said means for receiving having multiple apertures therein disposed in a sidewall, said apertures for receiving a fastener, whereby said cylindrical member can be attached to said means for mounting.

8. The apparatus of claim 1, said generally upstanding means for mounting further comprising an elongated rod-like member having a plurality of apertures therein, said apertures for receiving said means for attaching.

9. The apparatus of claim 7, further comprising said means for receiving being rotatably attached to said means for mounting.

10. The apparatus of claim 8, said rod-like member having a second means for mounting to an upstanding member.

11. The apparatus of claim 10, said second means for mounting further comprises said rod-like member having a plurality of apertures therein for receiving an elongated straplike member, said elongated strap-like member encircling said upstanding member whereby said rod-like member is attached to said upstanding member.

12. The apparatus of claim 8, further comprising at least a pair of elongated rod-like members being joined together by fasteners.

* * * * *